United States Patent [19]

Konstantin et al.

[11] Patent Number: 4,765,121

[45] Date of Patent: Aug. 23, 1988

[54] BANDING APPARATUS WITH FLOATING MANDREL

[75] Inventors: Anatole E. Konstantin; William N. Konstantin, both of Norwalk; Jaroslaw T. Malkowski, Shelton, all of Conn.

[73] Assignee: PDC International Corporation, Norwalk, Conn.

[21] Appl. No.: 53,266

[22] Filed: May 22, 1987

[51] Int. Cl.[4] ..... B65B 9/13; B65B 53/02

[52] U.S. Cl. ..... 53/442; 53/459; 53/567; 53/557; 53/585

[58] Field of Search ..... 53/567, 585, 49, 291, 53/557; 156/86

[56] References Cited

U.S. PATENT DOCUMENTS

| | | | |
|---|---|---|---|
| 3,551,258 | 12/1970 | Galvanoni | 53/291 X |
| 3,889,453 | 6/1975 | Hirai | 53/567 X |
| 3,974,628 | 8/1976 | Konstantin | 53/585 X |
| 4,016,704 | 4/1977 | Fujio | 53/585 X |
| 4,102,728 | 7/1978 | Smith | 53/291 X |
| 4,388,797 | 6/1983 | Shields | 53/585 |
| 4,545,181 | 10/1985 | Frankefort | 53/585 X |

FOREIGN PATENT DOCUMENTS

| | | | |
|---|---|---|---|
| 1561973 | 3/1980 | United Kingdom | 53/585 |

*Primary Examiner*—John Sipos

[57] ABSTRACT

Banding apparatus, which is capable of high speed operations, opens perforated, heat shrinkable, plastic tubing by use of a floating mandrel. Rollers or fingers, which exert force against the sides of the mandrel, are used to feed the tubing, tear the tubing at the perforations to form bands, and then push the bands off the mandrel and onto or over containers or articles to be banded.

15 Claims, 10 Drawing Sheets

FIG. 5
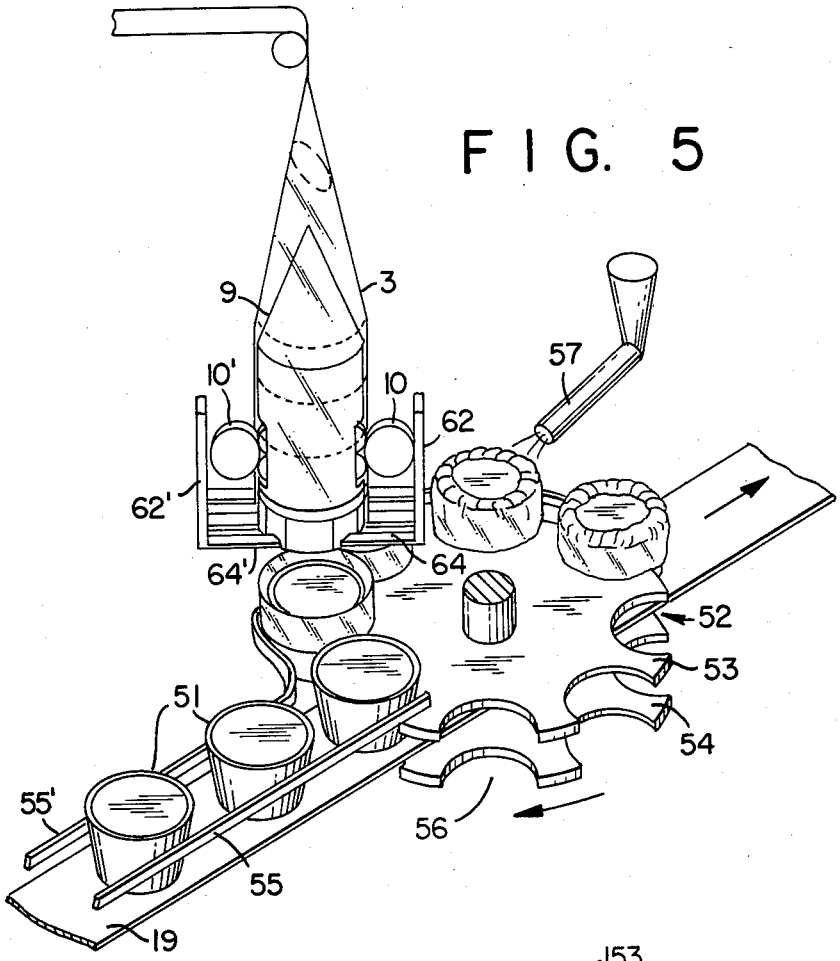
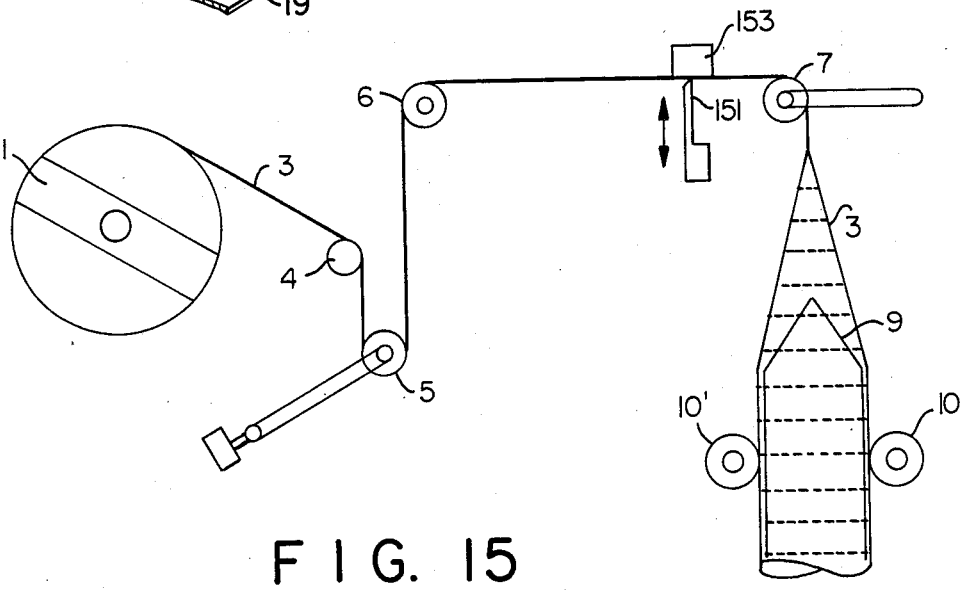
FIG. 15

FIG. 7
FIG. 6
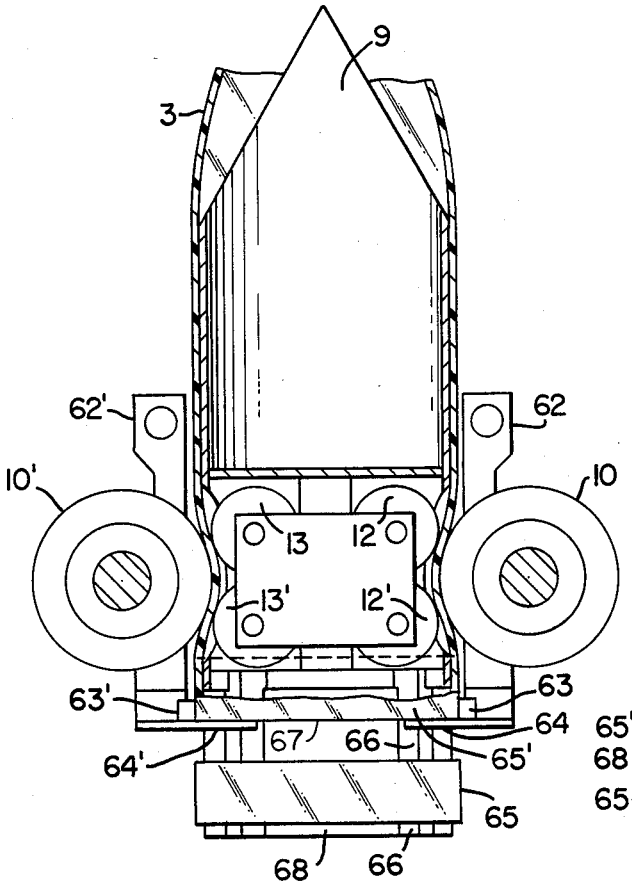
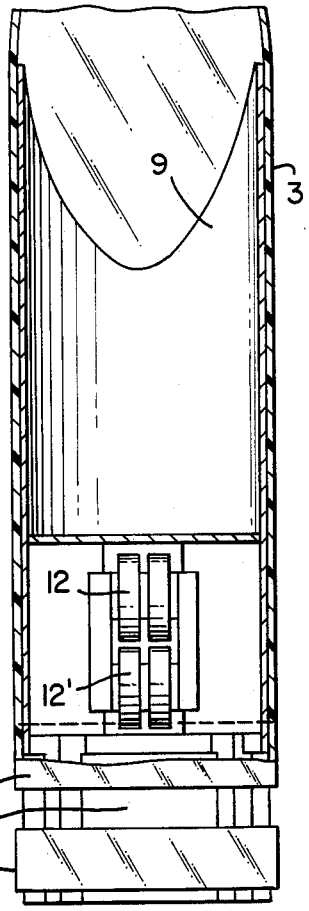
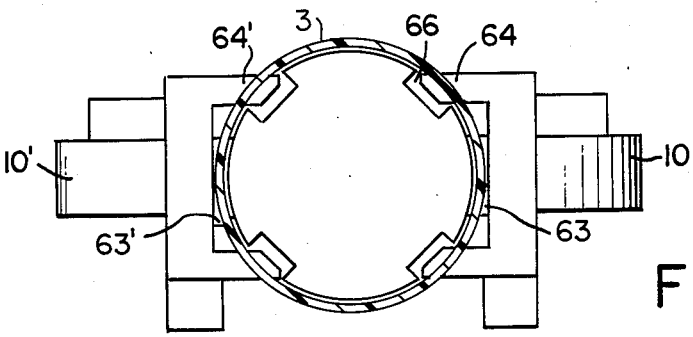
FIG. 8

BANDING APPARATUS WITH FLOATING MANDREL

TECHNICAL FIELD

This invention relates to apparatus for placing bands of heat-shrinkable plastic film, severed from continuous tubing, over containers or other articles to be banded.

BACKGROUND OF THE INVENTION

The use of banding with heat shrinkable plastic film is well-known for sealing containers such as bottles, jars, cans, tubs and the like in an effort to make the containers tamper-proof or at least tamper-evident. Such containers are commonly filled with medicine, foodstuff, drink, toiletries and similar products. Heat-shrinkable bands may also be used for labeling, as well as for packaging purposes; e.g. to fasten several articles together.

A machine suitable for such banding purposes is shown in my U.S. Pat. No. 3,924,387 issued on Dec. 9, 1975, the disclosure of which is incorporated herein by reference. Other patents which disclose methods and apparatus for banding are my U.S. Pat. Nos. 3,974,628 and 4,318,685. The banding machines disclosed in these patents, while generally useful, have certain limitations.

For example, the machine described in U.S. Pat. No. 3,924,387 requires the tubing to open by itself at least partially, i.e. to open as a result of the inherent resiliency of the tubing material. Only relatively heavy tubing has the required resiliency, but such tubing is more expensive than thin tubing. Thin-walled tubing is insufficiently resilient to open up by itself, particularly when charged with static electricity, which causes it to stick together. The machine shown in U.S. Pat. No. 3,974,628 is similarly limited, in that it requires tubing made of film sufficiently resilient to open up by itself in order to permit insertion of fingers into the partially opened tubing. Moreover, the complex operations performed by the mechanical fingers of this machine do not lend themselves to high speed operations.

Other prior art banding machines rely on suction cups to open the flattened tubing. However, suction cups tend to become unreliable at high speed.

A different approach for opening the tubing is shown by Holstein in U.S. Pat. No. 2,623,673 and by Aguilar in U.S. Pat. No. 2,765,607. Both of these machines open the tubing by passing it over a floating mandrel. Holstein's apparatus, however, is slow, since the tubing is not severed into bands until after it has been pushed down over the container to be banded.

Aguilar et al also disclose the use of a floating mandrel to keep the tubing open while it is placed over the neck of a bottle. Like Holstein, Aguilar et al sever the tubing only after it is over the neck of the bottle. The bottles are capped or banded on a rotating turntable on which each bottle is raised up by a rotating platform into the opened tubing. Thereafter, the tubing is cut by a rotating knife, and then the bottle containing the band is returned to the conveyor belt.

Because the tube cutting operations disclosed by both Holstein and Aguilar et al. cannot be started until after the desired length of tubing has been fed onto the bottle, the speed of the machine is limited, particularly when the diameter of the container is large, because the cut-off blades must travel around the entire circumference of the tubing.

In an efficient packaging operation it is desirable that the banding operation be sufficiently rapid to keep up with the rate at which the containers are being filled, and are hence ready for sealing or labeling. This makes it desirable to have banding machines that are capable of banding containers at rates in excess of several hundred containers per minute.

OBJECTS OF THE INVENTION

It is therefore an object of the present invention to provide banding apparatus that is capable of high speed operation, using thin, heat-shrinkable, plastic tubing and of placing bands over the containers or articles to be banded in a rapid, accurate and dependable manner.

It is another object of this invention to provide apparatus that is capable of forming bands into noncircular, i.e. polygonal or unsymmetrical cross-sectional configurations, and of placing such bands onto containers or articles of like cross-sectional shape.

SUMMARY OF THE INVENTION

The above and other objects, which will be apparent to those skilled in the art, are achieved by the present invention, which comprises:

apparatus for banding articles with heat-shrinkable plastic bands severed from tubing, comprising in combination:

(1) means for opening said tubing comprising a floating mandrel, said mandrel being sized to fit slideably inside of said tubing and provided with means for engaging suspension means external of said tubing, (2) suspension means external of said tubing, in rolling or sliding contact with the engaging means of said mandrel, thereby maintaining the mandrel in a floating position, (3) means for feeding incremental lengths of heat shrinkable, plastic tubing over said mandrel, said tubing having transverse perforations at predetermined intervals, (4) tear-off means, located downstream of said feeding means, capable of tearing off an incremental length of tubing at said perforations located between the feeding means and the tear-off means, thereby being capable of forming a band, (5) means for pushing the bands off the lower portion of said mandrel and onto the articles to be banded, and (6) means for conveying the banded articles to means for heat shrinking said bands.

If the tubing is not preperforated, then perforating means are included as a cooperating element of the apparatus.

The means used for tearing off the bands at their perforations may be of different types. One preferred type is comprised of a set of tear-off rollers, while another is comprised of a set of tear-off fingers. The type of tear-off mechanism used will depend upon the relative length and width of the bands required for the particular banding operation.

The means for pushing the plastic bands off the bottom of the mandrel and onto the articles to be banded may likewise comprise a set of driven rollers in friction contact with the bands or a set of oppositely spaced push off fingers.

As used throughout the present specification and claims, the term "article" is used to mean one or more articles to be banded either separately or together, as well as a container, e.g. a bottle, jar, can, etc. to be sealed or banded.

As used herein the term "mandrel" is intended to mean a device that fits inside the tubing. serving to keep the tubing open and conformed generally to the shape of the mandrel. The size of the mandrel is preferably slightly smaller than the inside of the tubing and has a smooth surface over which the tubing can slide easily. The mandrel also provides the surfaces against which the tube feeding means, the tear-off means and the band push off means exert pressure in order to perform their respective functions.

THE DRAWINGS

FIG. 5 is an isometric view of another preferred embodiment of banding apparatus in accordance with the present invention, illustrating a carousel assembly in cooperation with a floating mandrel having a set of tube feed rollers, band tear-off fingers and band push-off fingers.

FIGS. 6, 7 and 8 illustrate another preferred embodiment of the present invention, i.e. one having fingers that tear off a segment of plastic tubing at its perforations to form a band and then push the previously torn off band off the lower section of the mandrel, and onto the article to be banded.

Figure 13:
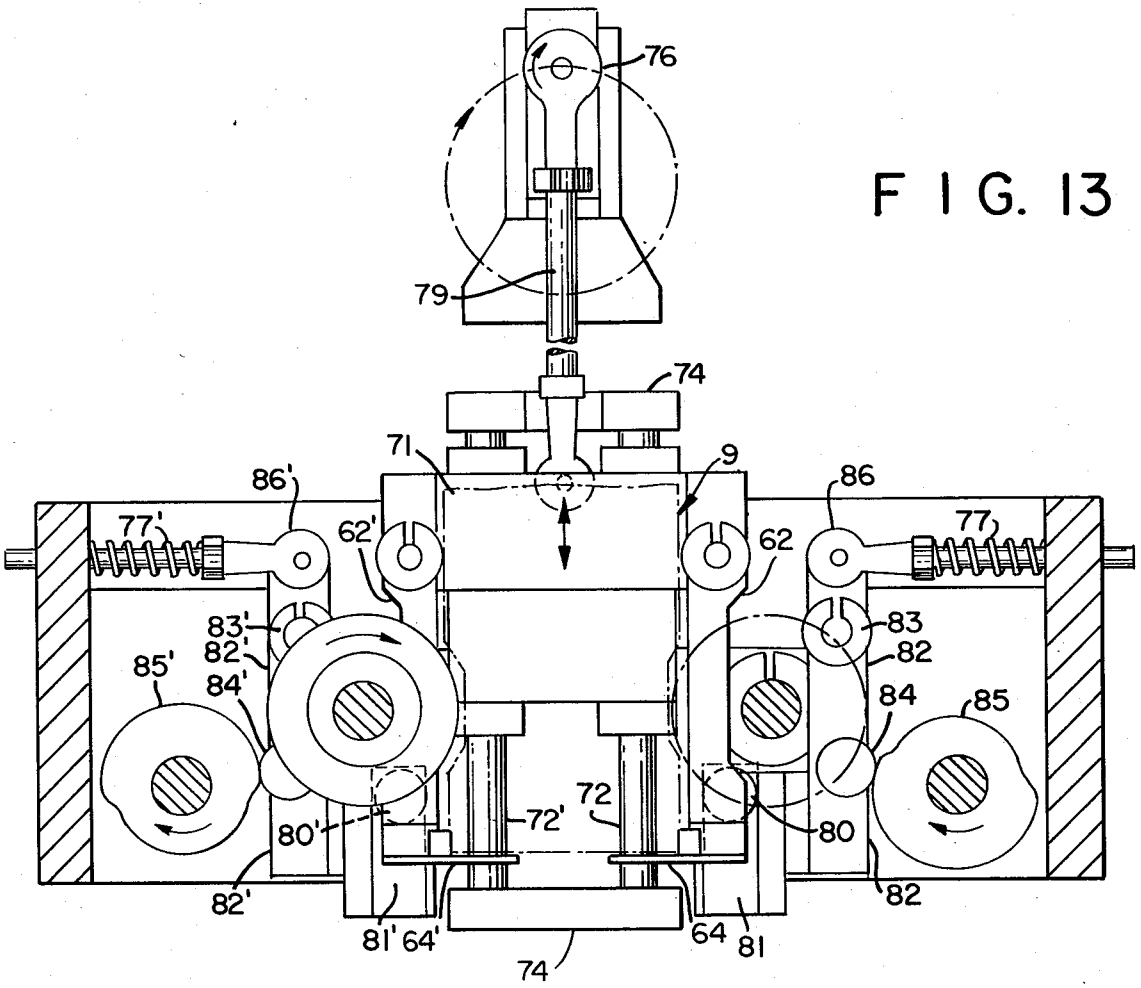

FIG. 13 discloses the same embodiment of the present invention as shown in FIGS. 6, 7 and 8 in a front view to further illustrate the manner in which the apparatus functions.

Figure 14:
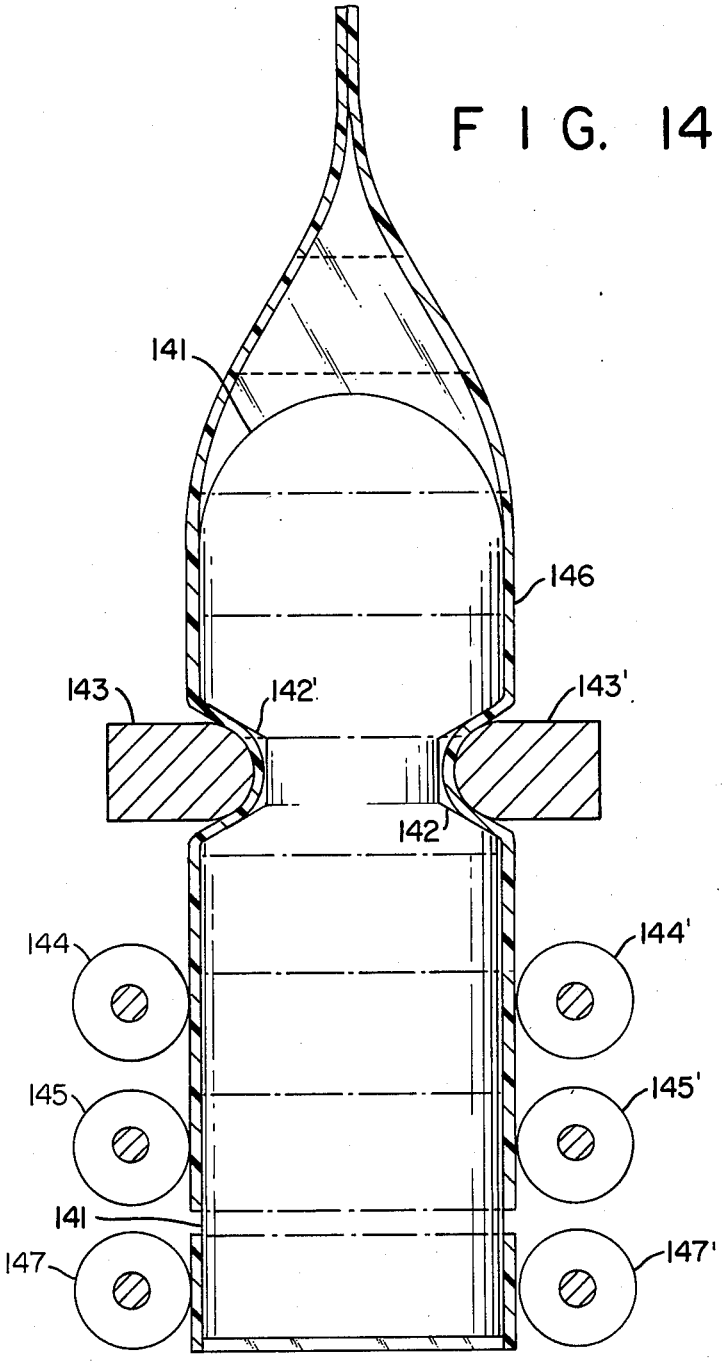

FIG. 14 illustrates still another embodiment of the present invention wherein the suspension means are stationary and separate from the tube feeding means.

FIG. 15 illustrates the preferred means for perforating tubing which has not been preperforated.

DETAILED DESCRIPTION

Figure 1:
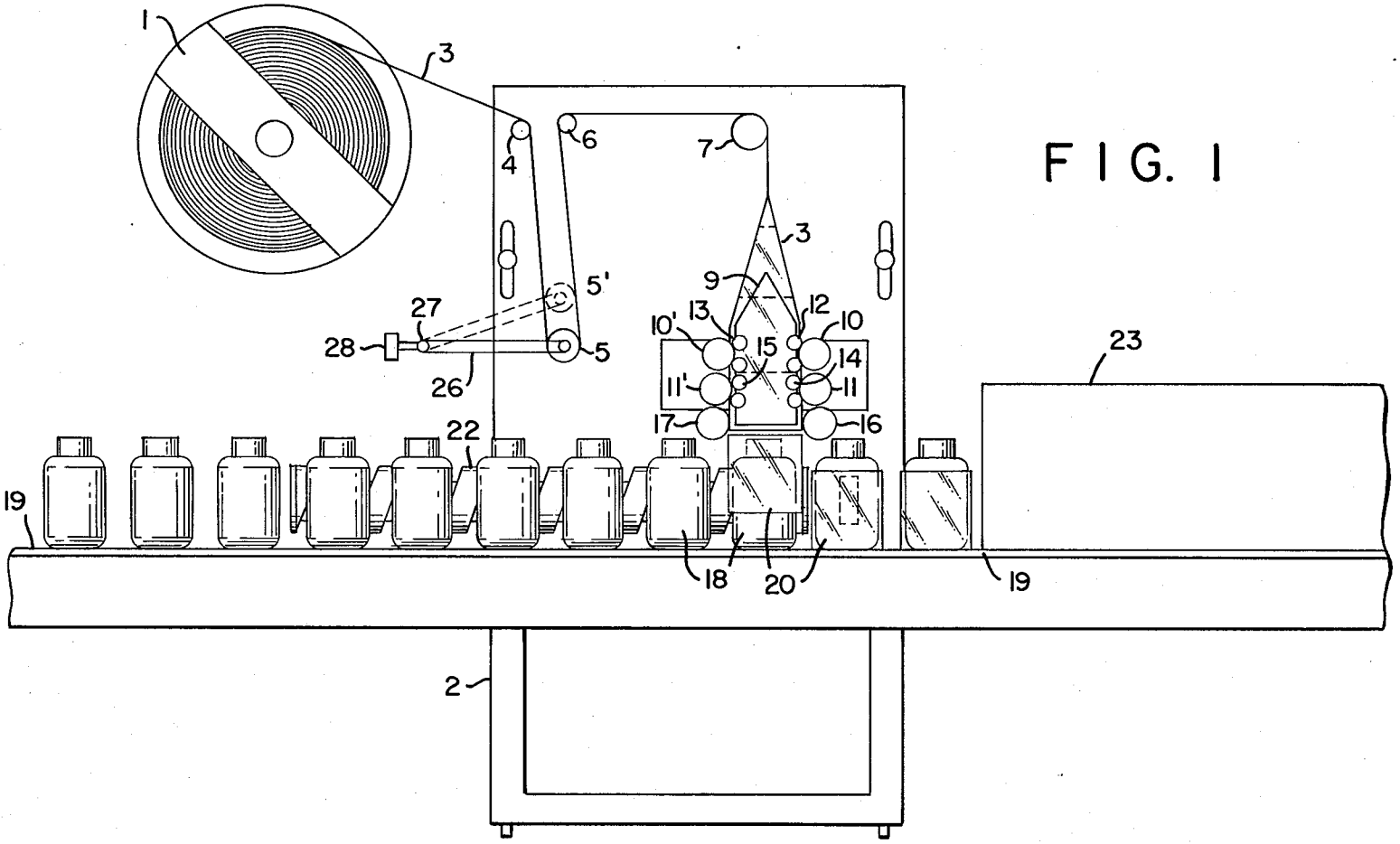
FIG. 1 is a side view of apparatus in accordance with the present invention showing the banding apparatus in cooperation with a conveyor and a heat-shrink tunnel.

In order to gain a better understanding of the structure and operation of the present invention, reference is made to the drawings. FIG. 1 illustrates apparatus having a tube reel 1 which contains a coil of flattened tubing. Reel 1 may be attached to rack 2 by conventional means (not shown). Flattened, preperforated plastic tubing 3 is threaded from real 1 over guide rollers 4, 5, 6 and 7, and then over a floating mandrel 9. The opened perforated tubing 3 is then fed between each set of feed rollers 10 and 10' and tear-off rollers 11 and 11'. As more clearly show in FIG. 2, each of the feed rollers 10 and 10' contact a set of suspension rollers 12, 12' and 13, 13' i.e. engaging means located inside of mandrel 9. Tear-off rollers 11 and 11' each contact a set of suspension rollers 14, 14' i.e. engaging means and 15, 15' likewise mounted inside mandrel 9. Contact between the suspension rollers and the feed and tear-off rollers is through cut out sections 8 on each side of mandrel 9 (see FIG. 2). Push-off rollers 16, 16' and 17, 17' push the bands 20 onto bottles 18 which are conveyed by a continuous conveyor belt 19 to heat shrink-tunnel 23. Bottles 18 are moved into proper synchronization with the banding station, i.e. under the mandrel, by screw feeder 22 which holds each container in place for the time necessary to have the band placed over it by the push-off rollers. The screw feed 22 thereafter ends, thus releasing the banded container to be moved by the continuously moving conveyor 19 to heat shrink tunnel 23.

Figure 2:
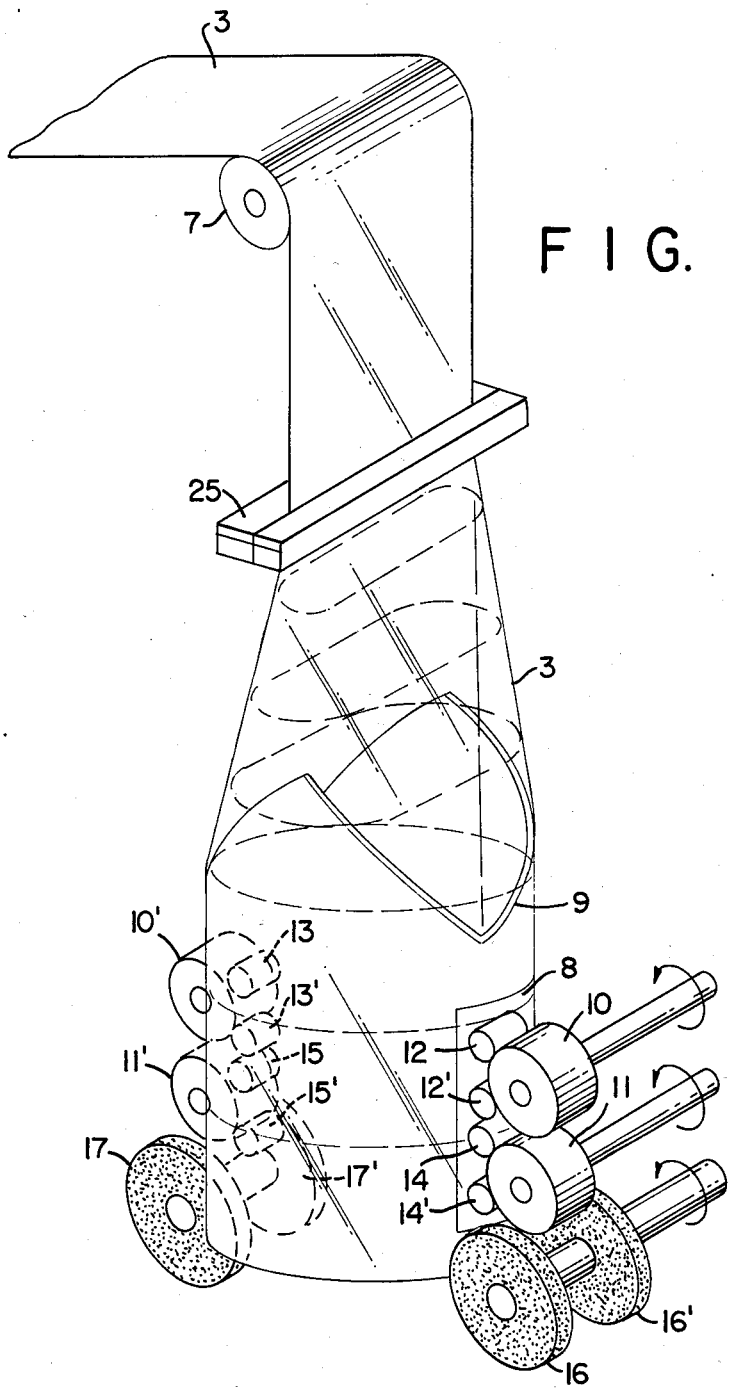
FIG. 2 is an isometric view of a preferred embodiment of this invention illustrating a floating mandrel having internally mounted rollers in cooperation with a set of combined suspension and feed rollers, a set of tear-off rollers and a set of push-off rollers.

Operation of the apparatus of FIG. 1 is shown in greater detail in FIG. 2, wherein it can be seen that the perforated plastic tubing 3 after passing over guide roller 7 is threaded through slit guide 25 and over mandrel 9 which is comprised of a rigid plastic tube of teflon or other suitable plastic or metal over which plastic tubing will slide easily. The "bishops hat" shape of the top of mandrel 9 is for purposes of helping to open the plastic tubing smoothly as it slides over the mandrel. The top of the mandrel may, however, have any smooth transitional shape, for example a cone, to open the tubing.

While the mandrel illustrated is a rigid tube 9 with sections 8 cut out of each side wall to permit the rollers 12, 13, 14 and 15 to come in rolling contact with feed and tear-off rollers 10 and 11, it should be understood that the mandrel need not be a rigid tube, but may be constructed of a flexible tube, of a wire mesh or of a solid bar of any suitable material. Moreover, the mandrel need not be cylindrical as illustrated, but may be of any cross-sectional shape desired, e.g. square, polygonal, elliptical or asymmetrical. Preferably, the cross-section of the mandrel is of the same shape and size as the container or article to be banded. By so doing, the plastic tubing and the torn off band is formed so as to take the same shape as the container to be banded, making placement of the shaped band onto the container a simple matter of pushing the band off the lower section of the mandrel and directly onto the like-shaped container.

It should be noted that guide roller 5 in FIG. 1 is attached to arm 26 which is pivotally mounted at 27 and is provided at its opposite end with a counterweight 28. The reason for making guide roller 5 "float" on swing arm 26 is to minimize tension on the tubing 3 as it is fed downward over the mandrel 9 by feed rollers 10 and 10'. In operation, the feed rollers 10, 10' are activated by an electrical signal to feed a segment of tubing 3 equal to the length of a band, i.e. the distance between two successive perforations and such as to locate the transverse perforations between the feed rollers 10, 10' and the tear-off rollers 11, 11'. During such feeding interval, the driven reel 1 is held stationery; hence, the unwound length of the tubing is shortened by the length of a band. This shortening of the tubing is taken up by having roller 5 move up to the position shown at 5'. Thereafter, driven reel 1 is electronically activated to release a band length of tubing and roller 5' moves back down to the position shown at 5. This floating action by roller 5 prevents excessive tension on the tubing which might otherwise tear, especially preperforated tubing, if the force of the feed rollers 10, 10' were transmitted through the tubing all the way back to reel 1 to unravel the tubing.

Figure 3:
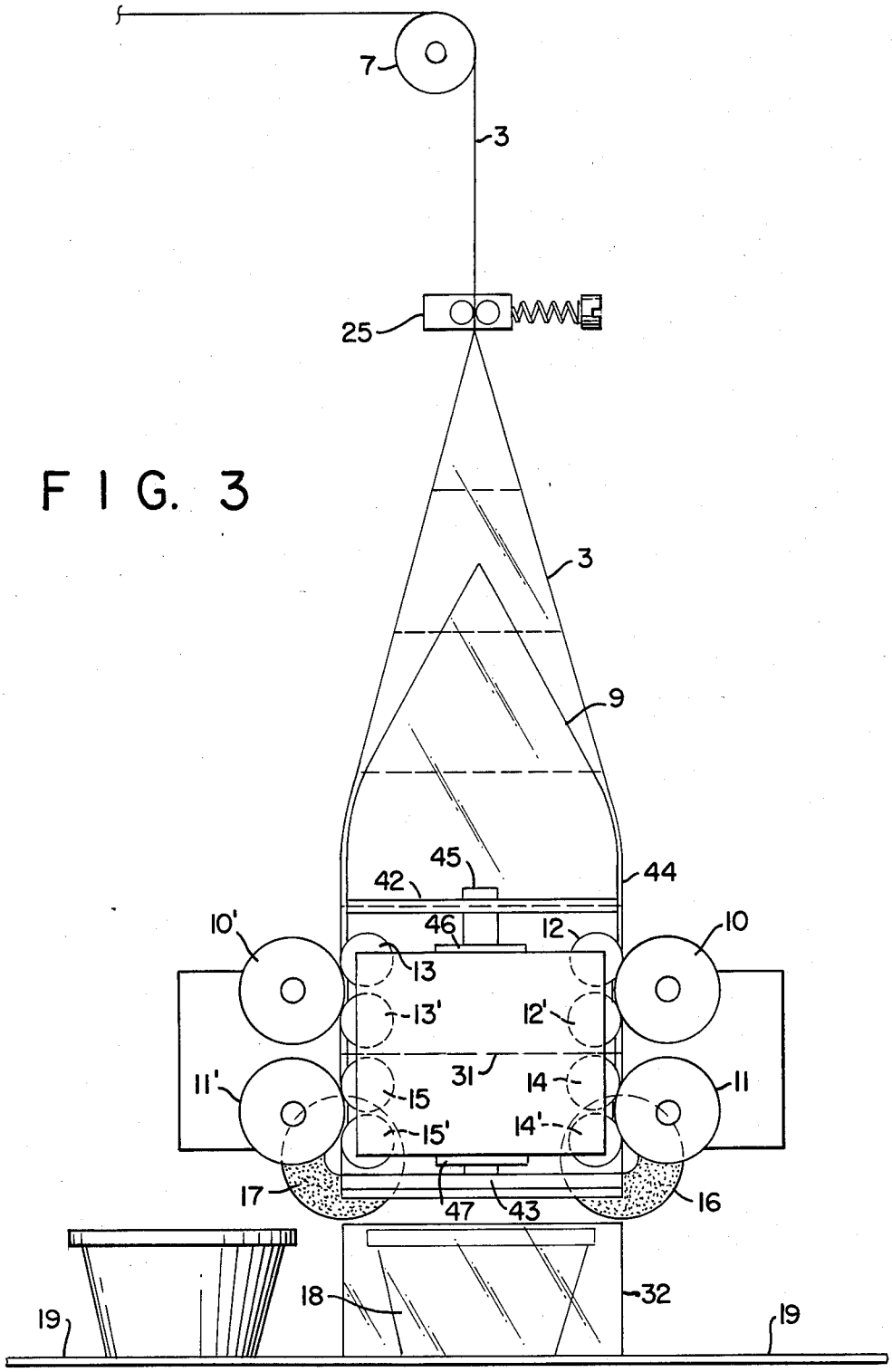
FIG. 3 is a front view in partial cross-section of the embodiment illustrated in FIG. 2.
Figure 4:
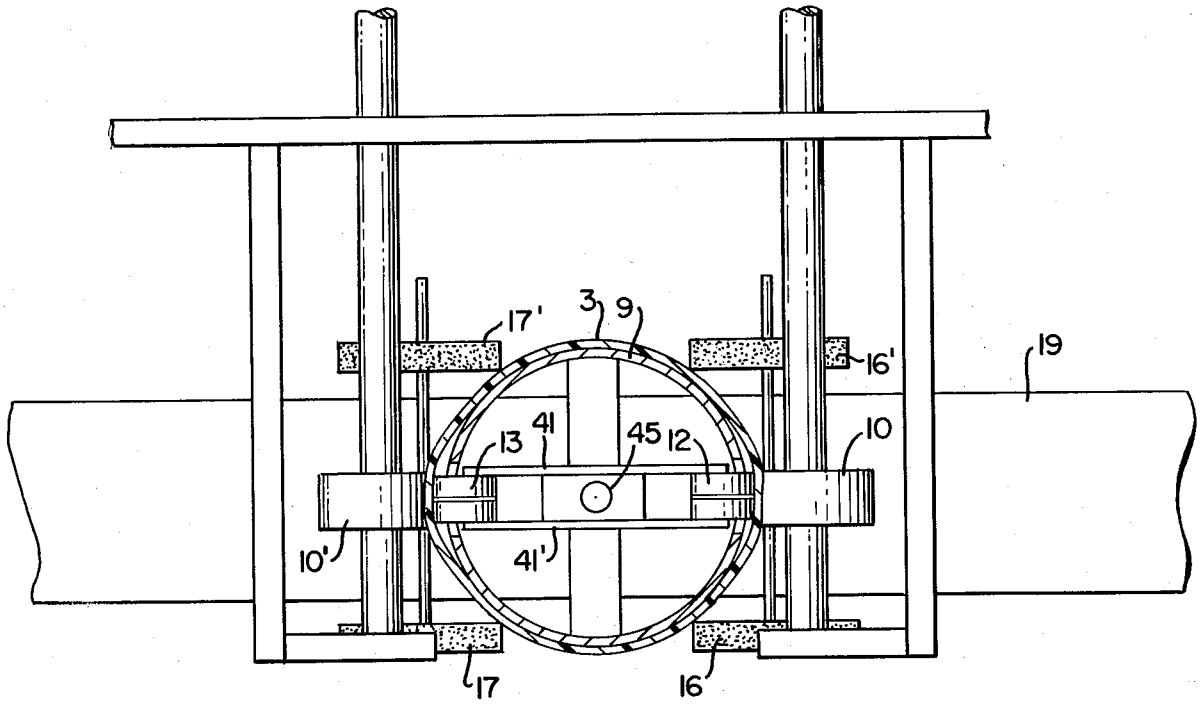
FIG. 4 is a top view in partial cross section of the embodiment shown in FIG. 2.

FIGS. 3 and 4 are front and top views in partial cross-section of the embodiment illustrated in FIG. 2. As perforated tubing 3 is fed over mandrel 9, it passes between feed rollers 10 and 10' and the respective sets of suspension rollers 12, 12' and 13, 13'. These rollers function to feed the tubing downward until the perforations 31 are below the feed rollers, at which point the feed rollers are caused to stop, while the tear-off rollers 11 and 11' continue to rotate, thereby tearing off a band 32 at perforations 31. Band 32 is then pushed off the bottom of mandrel 9 by push-off rollers 16 and 17 and onto container 18 which sits on conveyor belt 19.

In the embodiment shown in FIGS. 1 through 4, the feed rollers, as well as the tear-off rollers serve a double function. In addition to feeding the tubing and tearing off bands, these rollers also serve to keep the mandrel "floating" by being in contact through the tubing with their corresponding sets of suspension rollers 12 through 15 mounted inside mandrel 9.

The suspension rollers 12 throuqh 15 may be mounted inside of the rigid tube which forms mandrel 9 by any suitable means. In the embodiment shown in FIGS. 3 and 4, they are rotatably attached through axles (not shown) fixedly attached at their ends to two vertical plates 41 and 41'. These plates in turn are fixedly attached to horizontal plates 42 and 43 that are glued, welded or otherwise affixed at their edges to the tube 44 which forms the mandrel 9. The inside suspension roller assembly may be attached to plates 42 and 43 by means of a threaded rod 45 and held fast by nuts 46 and 47 at ends of rod 45 or by any other suitable means of attachment.

FIGS. 5 through 13 illustrate another preferred embodiment of the present invention, wherein the tear off means are fingers rather than rollers. Rollers cannot be used to tear off bands that are shorter than the distance between the tear-off rollers and the feed rollers. In such cases fingers such as shown in FIGS. 5 through 13 can be used to perform the tear-off function.

In FIG. 5 conveyor belt 19 conveys successive containers 51 to an indexing carousel assembly generally shown as 52. Carousel 52 is comprised of paralleled upper and lower plates 53 and 54 which are intermittently rotated in the direction of the arrow. Rails 55 and 55' guide the containers 51 into pockets 56 in the carousel plates, which then rotate, i.e. index the containers into position under mandrel 9. As the container over which a band has been placed rotates to the next station, a preshrinking heater 57 blows warm air at the band causing it to shrink sufficiently around the container to prevent the band from falling down after the carousel rotates the partially shrunk banded container back onto the conveyor 19. Prior to being preshrunk, the band is prevented from falling down to the base of a shoulderless container by resting on top of plate 53. Obviously, if the container has a shoulder on which the band can sit, such as a bottle, the upper plate 53 of the carousel 52 may be omitted.

The function and structure of this embodiment of the invention is more clearly understood with reference to FIGS. 6 through 13.

FIGS. 6, 7 and 8 illustrate, in cross-section, in front, side and top views respectively another preferred embodiment of the present invention wherein the tear-off means are a set of oppositely spaced fingers, each of which is comprised of arms 62 and 62' hingedly attached at their upper ends to a slide (shown in FIG. 13) which moves the fingers up and down in unison (more clearly shown in FIGS. 9 through 12). The base of arms 62 and 62' are provided with tear-off pads 63 and 63' made of a high-friction material such as a polyurethane plastic to grip the tubing and tear off a band 65. A set of attached stripper fingers 64 and 64' which, when in their closed position as shown in FIG. 6, fit between the torn-off band 65 and the bottom edge 67 of tube 3 above it. As shown in FIG. 8, stripper fingers 64 and 64' also fit into the four vertical channels 66 which have been cut out of the solid lower section 68 of the mandrel 9. when the arms 62 and 62. move down, the stripper fingers 64 and 64' engage the upper edge of band 65 and push it off the mandrel 9 and onto the container (not shown) underneath it.

Figure 9:
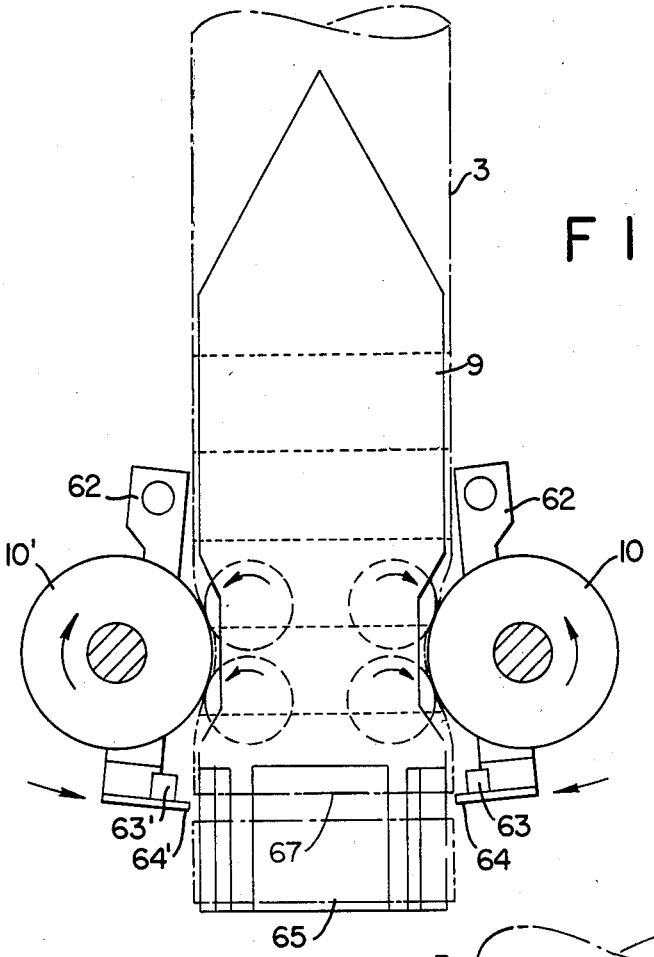
FIGS. 9, 10, 11 and 12 show in greater detail the sequence and operation of the apparatus shown in FIGS. 6, 7 and 8.
Figure 10:
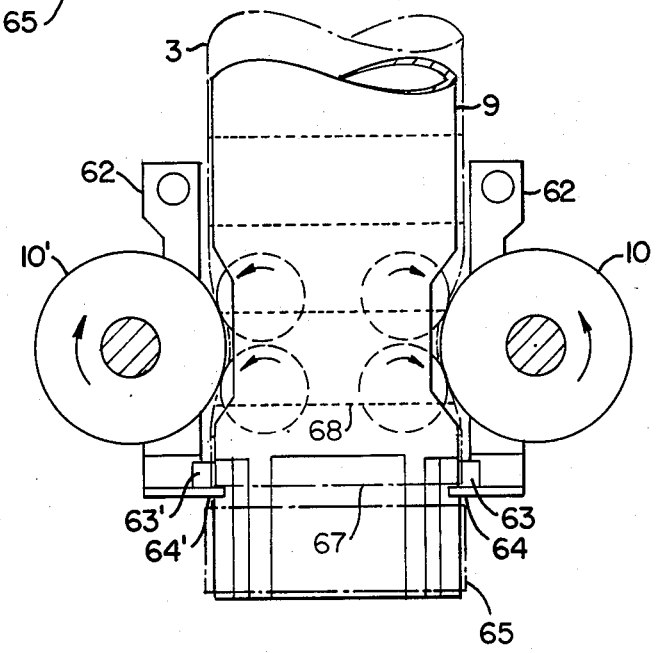
Figure 11:
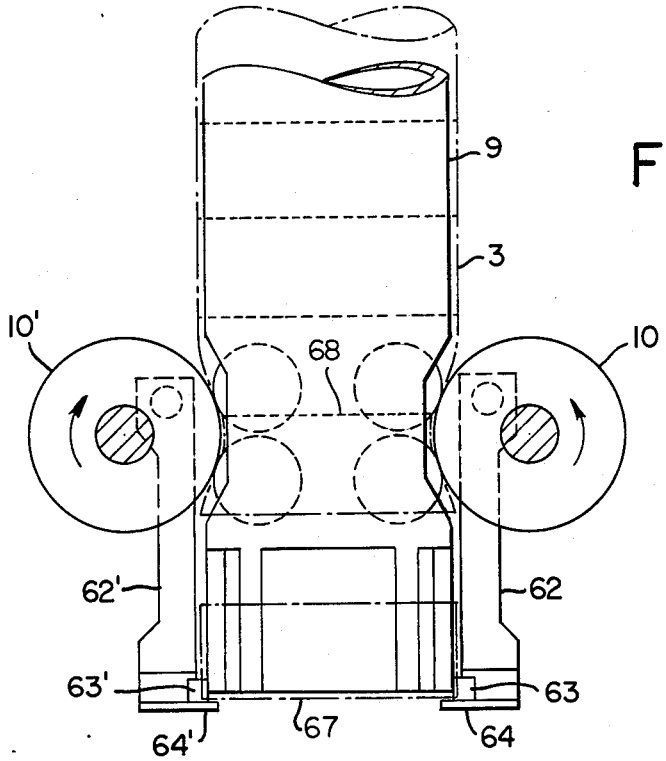
Figure 12:
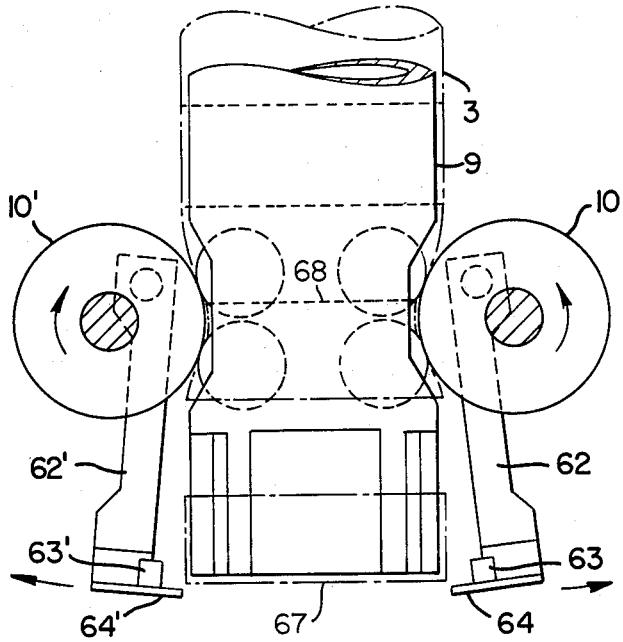

The manner in which the arms 62 and 62' function to tear-off bands from the perforated tubing 3 can be seen in chronological sequence in FIGS. 9 through 12. In FIG. 9 arms 62 and 62' are open and beginning to close in order to grasp the lower most segment of plastic tubing 3 at the point where pads 63 and 63' will contact and grip the tubing 3, just above its bottom edge 67. When the arms are fully closed, as shown in FIG. 10, feed rollers 10 and 10' are in a stopped position, and the downward motion of arms 62 and 62' begins, thereby tearing a band from tubing 3 at its perforations 68. In FIG. 11, the tear-off arms 62 and 62' have been moved to their bottom position, thereby tearing off a band 67 and having pulled it down to the lower section of mandrel 9. Thereafter, as shown in FIG. 12, arms 62 and 62' swing back as shown by the direction of the arrow to release band 67, which, due to the fact it is only slightly larger in its perimeter than the mandrel 9, will tend to remain on or may be held by brushes (not shown) on the mandrel until pushed off, which it will be, on the next cycle by fingers 64 and 64'. As can be seen in FIGS. 9 through 12, at the same that that arms 62, 62' tear off one band, they simultaneously push the band below off the mandrel 9 with the stripper fingers 64, 64' which are attached to the base of arms 62 and 62' respectively.

FIG. 13 illustrates the manner in which the arms 62 and 62' are caused to move up and down, while simultaneously opening and closing about the mandrel 9. The arms 62, 62' are pivotally attached at their upper ends to slide support 71 which is slideably attached to a pair of vertical shafts 72, 72' which are held firmly in place by being fixedly attached at their upper and lower ends to horizontal shaft support numbers 74 and 74'. Slide support 71 is driven up and down by crank 76 through connecting rod 79. Arms 62 and 62' are moved toward and away from the mandrel 9 by cams 85 and 85' through rollers 80 and 80' respectively, which are attached to arms 62 and 62' and ride up and down in channels 81 and 81'. Channels or tracks 81 and 81' are attached to arms 82 and 82' which are pivotably attached to the main frame at 83 and 83'. Track arms 82 and 82' have cam followers 84 and 84' which ride on the perimeter of driven rotating cams 85 and 85' Cams 85 and 85', through cam followers 84 and 84', arms 82 and 82 , channels 81 and 81' and rollers 80 and 80' move the arms 62 and 62 towards mandrel 9. Springs 77 and 77' act upon the channel or track arms 82 and 82' at points 86 and 86' to keep cam followers 84 and 84' in contact with cams 85 and 85'.

All of the movements of the apparatus are preferably driven by an electric motor through chain driven means synchronosly locked together, since such drive means have been found to be the most reliable and accurate for high speed operations.

FIG. 14 illustrates in cross-section an embodiment which does not require the use of rollers inside the mandrel. In such embodiments mandrel 141 is simply provided with a wedge shaped cut out portions 142 and 142' i.e. engaging means which together with stationary support members 143 and 143' function to suspend or float the mandrel 141 in its floating position. The wedge shape may alternatively be semicircular in shape. Moreover, the tubing feed rollers 144 and 144', the tear-off rollers 145 and 145' and the push off rollers 147 and 147' may all function simply by being in frictional contact with the outer surface of the tubing 146 which slides over mandrel 9.

FIG. 15 illustrates the use of a perforator 151 which may be a driven reciprocating gaped or spaced knife edge 152 which perforates the tubing 3 as the knife edge 152 strikes against anvil 153. Knife edge 152 is timed so as to perforate the tubing at predetermined intervals equal to the lengths of the bands desired to be torn from the tubing 3. Obviously, if the tubing is preperforated, the perforator shown is not required. It should be noted, however, that several perforations per band of various tear resistance may be used, for example, if bands having perforations are desired for banding purposes. In such case, the weaker perforation will be torn to form the band with the stronger remaining as part of the band.

We claim:

1. Apparatus for banding articles with heat-shrinkable plastic bands severed from tubing having transverse perforations at predetermined intervals, comprising in combination:

(1) means for opening said tubing comprising a floating mandrel, said mandrel being sized to fit slideably inside of said tubing and provided with means for engaging suspension means external of said tubing, (2) suspension means external of said tubing, in rolling or sliding contact with said engaging means, thereby maintaining the mandrel in a floating position, (3) unified means for feeding incremental lengths equal to the distance between perforations of heat-shrinkable plastic tubing over said mandrel and clamping said tubing, (4) tear-off means, located downstream of said feeding and clamping means, capable of tearing off an incremental length of tubing at said perforations located between the said unified feeding and clamping means and the tear-off means, thereby being capable of forming a band, (5) means for pushing the bands off the lower portion of said mandrel and onto the articles to be banded, and (6) means for conveying the banded articles to means for heat shrinking said bands.

2. The apparatus of claim 1 which in addition comprises means for perforating the tubing at predetermined intervals.

3. The apparatus of claim 1 wherein the mandrel comprises a rigid tube.

4. The apparatus of claim 1 wherein the mandrel is comprised of an upper section and a lower section, and wherein the upper section is comprised of a plastic tube and the lower section is comprised of a solid plastic.

5. The apparatus of claim 3 wherein the tube is generally cylindrical in shape.

6. The apparatus of claim 1 wherein the suspension means are stationary.

7. The apparatus of claim 1 wherein the suspension means are rollers.

8. The apparatus of claim 1 wherein the tear-off means are rollers.

9. The apparatus of claim 1 wherein the tear-off means are fingers.

10. The apparatus of claim 4 wherein the tear-off means are fingers, and the lower section engaged by the fingers is of teflon or is teflon coated.

11. The apparatus of claim 1 wherein the cross-sectional shape of the mandrel is the same as the cross-sectional shape of the article to be banded.

12. The apparatus of claims 2 wherein the suspension means are rollers, the means for feeding are rollers, the tear-off means are rollers and the means for pushing the plastic bands off the mandrel are rollers.

13. The apparatus of claim 9 wherein the tear-off fingers have push-off means attached thereto.

14. The apparatus of claim 4 wherein the lower section only of the mandrel has the same cross-sectional shape as the article to be banded.

15. A method for banding articles with heat-shrinkable plastic bands comprising the steps of:

(1) providing tubing having transverse perforations at predetermined intervals, (2) opening said tubing with a mandrel that fits slideably inside of said tubing, (3) providing rolling or sliding suspension means external of said tubing for suspending said mandrel, (4) maintaining the mandrel in a floating position by rolling or sliding contact through said tubing with said external suspension means, (5) providing unified means capable of feeding and clamping said tubing by contacting said mandrel through said tubing, (6) feeding predetermined incremental lengths of said tubing over said mandrel, (7) providing means capable of tearing off incremental lengths of tubing, (8) forming bands from said tubing by successively tearing off incremental lengths of said tubing at said perforations, when said perforations are located between the unified feeding and clamping means and the tear-off means, by stopping the unified feeding and clamping means, thereby clamping same, while simultaneously continuing operation of the tear-off means, (9) pushing the bands off the lower portion of said mandrel and onto the articles to be banded, and

(10) heat shrinking said bands about said articles.

* * * * *